US006442988B1

(12) United States Patent
Hamstra et al.

(10) Patent No.: US 6,442,988 B1
(45) Date of Patent: Sep. 3, 2002

(54) METHODS OF SPIN FORMING INITIALLY CYLINDRICAL CONTAINERS AND THE LIKE

(75) Inventors: Peter Hamstra, Kingston; Stuart MacEwen, Inverary, both of (CA)

(73) Assignee: Alcan International Limited, Montreal (CA)

( * ) Notice: Subject to any disclaimer, the term of this patent is extended or adjusted under 35 U.S.C. 154(b) by 0 days.

(21) Appl. No.: 09/846,169

(22) Filed: May 1, 2001

(51) Int. Cl.[7] ..... B21B 19/08

(52) U.S. Cl. ..... 72/96; 72/100; 72/370.24; 72/379.4

(58) Field of Search ..... 72/80, 95, 96, 72/98, 100, 120, 121, 370.01, 370.23, 370.24, 379.4

(56) References Cited

U.S. PATENT DOCUMENTS

| | | | | | |
|---|---|---|---|---|---|
| 3,759,203 | A | * | 9/1973 | Frankenberg | 72/379.4 |
| 3,847,001 | A | * | 11/1974 | Thamasett | 72/96 |
| 4,320,644 | A | * | 3/1982 | Fischer | 72/75 |
| 5,533,373 | A | * | 7/1996 | Plester | 72/84 |
| 5,622,070 | A | | 4/1997 | Bulso, Jr. | 72/68 |

FOREIGN PATENT DOCUMENTS

| | | | | |
|---|---|---|---|---|
| DE | 2135260 | * | 2/1972 | 72/96 |
| DE | 3106245 | * | 7/1982 | 72/379.4 |
| WO | 9749509 | | 12/1997 | |

* cited by examiner

*Primary Examiner*—Ed Tolan
(74) *Attorney, Agent, or Firm*—Cooper & Dunham LLP

(57) ABSTRACT

A method of spin forming an open-ended container or other cylindrical metal workpiece by inserting a conically tapering mandrel coaxially therein and pressing the side wall of the workpiece against the inserted mandrel with plural symmetrically arranged forming discs while unidirectionally translating the workpiece, and independently translating the mandrel, relative to the forming discs.

11 Claims, 3 Drawing Sheets

METHODS OF SPIN FORMING INITIALLY CYLINDRICAL CONTAINERS AND THE LIKE

BACKGROUND OF THE INVENTION

This invention relates to methods for spin forming initially cylindrical workpieces such as containers and like articles, and more particularly, initially cylindrical metal containers. Typically, the spin forming operation imparts to the container a noncylindrical (e.g. bottle-shaped) though radially symmetrical configuration along at least part of its length.

One specific though nonlimiting application of the invention is in the formation of bottle-shaped containers of aluminum or other metal.

Metal cans are well known and widely used for beverages. Present day beverage can bodies, whether one-piece "drawn and ironed" bodies, or bodies open at both ends (with a separate closure member at the bottom as well as at the top), generally have simple upright cylindrical side walls. It is sometimes desired, for reasons of aesthetics, consumer appeal and/or product identification, to impart a different and more complex shape to the side wall of a metal beverage container, and in particular, to provide a metal container with the shape of a bottle rather than an ordinary cylindrical can shape. Conventional can-producing operations, however, do not achieve such configurations.

For these and other purposes, it would be advantageous to provide convenient and effective methods of forming initially cylindrical side walls of containers or other workpieces into bottle shapes or other complex shapes, free of the difficulties (such as wrinkling of the workpiece wall) that sometimes attend such forming procedures.

SUMMARY OF THE INVENTION

The present invention broadly contemplates the provision of a method of spin forming a hollow workpiece having an initially cylindrical side wall portion with an axis and at least one open end, comprising disposing, coaxially within the side wall portion, a mandrel tapering conically in one direction from a region of maximum radius at which the mandrel is in substantially 360° contact with the side wall portion; disposing a plurality of rotatable spin-forming discs symmetrically externally around and in edgewise contact with the side wall portion at a location, along the axis, through which the mandrel extends, for pressing inwardly against the side wall portion at that location; and rotating the workpiece about the axis while unidirectionally translating the workpiece along the axis (relative to the forming discs) in the direction of taper of the mandrel, moving the forming discs radially symmetrically in maintained edgewise spin-forming contact with the cylindrical side wall portion at the aforesaid location to vary the radial distance of the discs from the axis, and translating the tapering mandrel along the axis relative to the forming discs and the workpiece to vary the radius of the tapering mandrel at the aforesaid location concomitantly with the varying radial distance of the discs from the axis.

Conveniently or preferably, the rotating step comprises positively rotating the workpiece about its axis, with rotation being transmitted by the workpiece to the mandrel and forming discs by frictional contact of the workpiece therewith. The translating step may comprise translating the workpiece along the axis in the aforesaid direction of taper, and independently translating the mandrel along the axis, while the discs are substantially stationary in position along the axis. Alternatively, the translating step may be performed by translating the forming discs along the axis in a direction opposite to the direction of mandrel taper, and independently translating the mandrel along the axis, while the workpiece is substantially stationary in position along the axis.

The workpiece may be a cylinder of initially uniform radius, open at both ends, or a preformed container having one closed end. Also, it may include a noncylindrical portion disposed in tandem relation to the cylindrical side wall portion, in which case the method of the invention is employed only to form the latter portion.

In particular embodiments, the workpiece is a metal container, and spin forming in accordance with the invention is performed to impart a bottle shape to the workpiece. However, the invention in its broadest aspects is not limited to forming bottle shapes or to containers, but may be applied to hollow formable cylindrical workpieces for other decorative and/or functional purposes.

For especially severe forming operations, where the amount of deformation would result in wrinkling of the side wall portion of the workpiece if performed by a single set of discs, the plurality of discs may include two or more sets of symmetrically disposed discs arranged in tandem along the axis.

Further features and advantages of the invention will be apparent from the detailed description hereinbelow set forth, together with the accompanying drawings.

DETAILED DESCRIPTION

The invention will be described, for purposes of illustration, as embodied in methods of creating a bottle shape or other complex radially symmetrical shape in an initially cylindrical metal container side wall by a spin-forming procedure employing an axially translatable tapered mandrel inserted coaxially within the side wall (through an open end thereof) together with freely rotating forming discs that bear in edgewise contact against the outer surface of the cylindrical container side wall as it spins and are radially movable toward and away from the common axis of the mandrel and side wall. The degree of deformation of the side wall is controlled by the positioning of the tapered mandrel. The tapered shape of the mandrel allows the mandrel to remain axially centered in relation to the side wall throughout the forming process; to enable the creation of complex, convoluted side wall shapes with freedom from wall wrinkling; and to be easily removable from the container at the end of the spin-forming procedure.

The workpiece to which the method is applied is a cylindrical metal preform, having a hollow cylindrical side wall, such as a container preform or metal tube; it may be open at both ends or, as in the case of a beverage container, open at one end and closed at one end. The method produces a profile on the workpiece or preform by spin-forming against the tapered mandrel inserted within the cylindrical side wall.

The profile to be imparted to the side wall of the workpiece is defined by specifying how the radius of the formed product varies with position along the axis of the side wall. The only restriction is that this radius may not be greater than that of the preform.

Figures 1A, 1B, 1C:
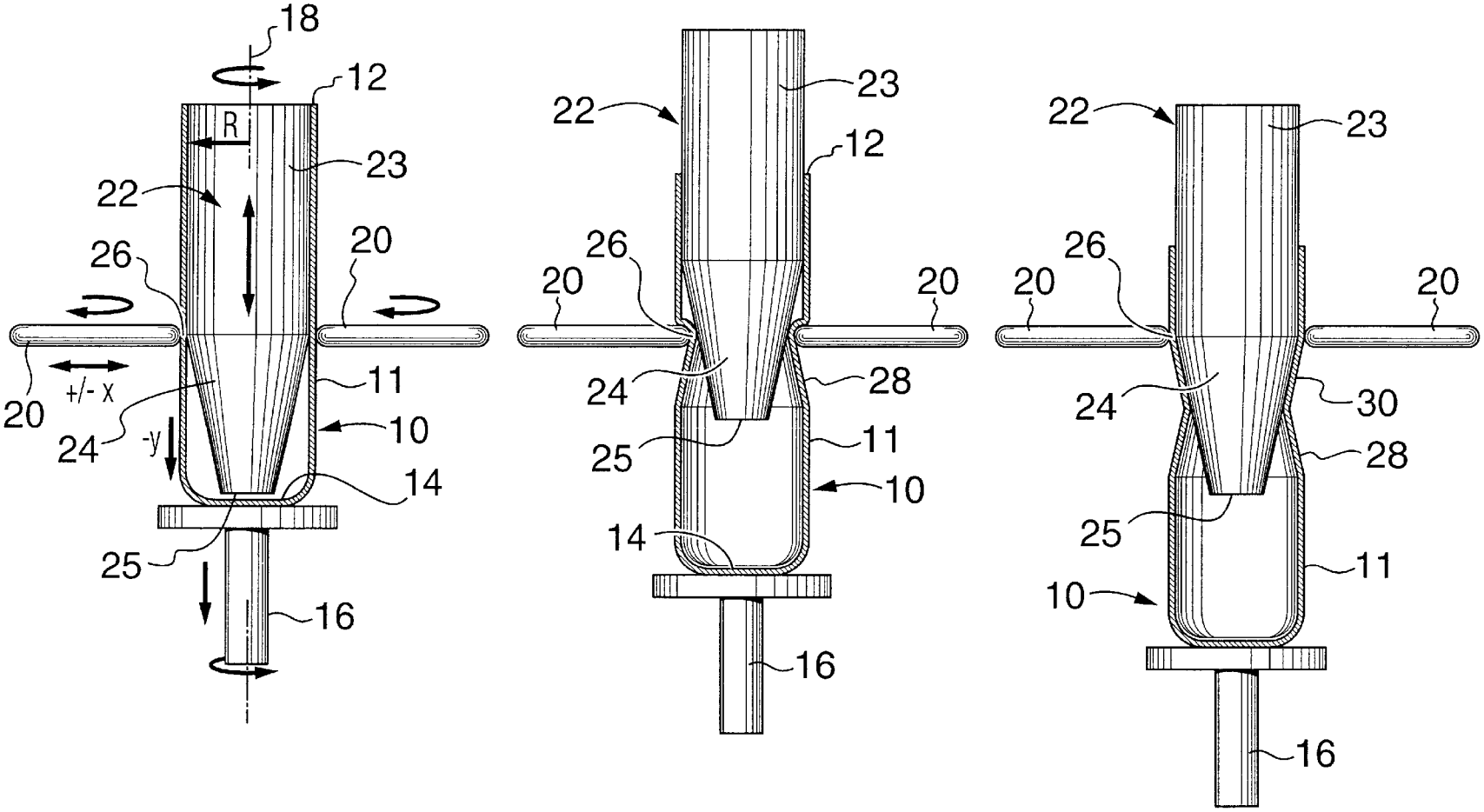
FIGS. 1A, 1B and 1C are simplified schematic side elevational views of a spin forming system illustrating successive stages in an exemplary embodiment of the method of the invention for spin forming a container (shown in section)

As shown in FIGS. 1A–1C, the workpiece or preform may be an aluminum one-piece container body 10 including a side wall 11 having an open top end 12 and a bottom end closed by a base 14 formed integrally therewith. The tooling for the practice of the method to shape this preform, shown as arranged with reference to an axially vertical orientation of the preform (with the open end 12 of the preform uppermost), includes a lower support table 16 to which the preform is attached (e.g. by vacuum and/or axial pressure). The table is positively driven for rotation about a vertical axis coincident with the geometric axis 18 of the preform side wall 11 and also for translation, in a downward (−y) direction along the axis 18, thus causing rotation and translation of the preform.

Figure 2:
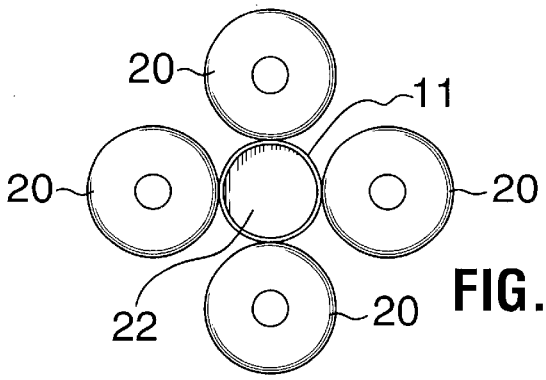
FIG. 2 is a similarly schematic top plan view of the system of FIGS. 1A–1C,. as it appears at the stage of the method shown in FIG. 1A.

The tooling also includes a set of spin-forming discs 20 (four being shown in FIG. 2), arranged symmetrically around the exterior of the preform so as to be in edgewise contact therewith; the location, on axis 18, at which the four discs 20 thus engage and bear inwardly against the outer surface of the preform side wall may conveniently be envisioned as a plane perpendicular to the axis 18, although the discs themselves do not necessarily have parallel axes or lie in a common plane. These forming discs are freely rotatable so that they pick up the spin of the preform; i.e., the driven rotation of the preform side wall is imparted to the forming discs by the frictional contact of the discs with the side wall. In addition, the discs move in radial directions relative to the axis 18, as will be hereafter further explained. The angle of the axes of the individual forming discs, relative to the axis 18, and the edge contour of the forming discs can be optimized to the profile being formed so as to minimize axial load. The combination of axial motion of the preform and radial motion of the spin-forming discs defines the profile spun onto the preform.

Further, the tooling includes an axially rectilinear tapered mandrel 22, having a cylindrical region 23 (the radius R of which is the maximum radius of the mandrel) and a portion 24 tapering conically and unidirectionally from the region 23 to the forward free end 25 of the mandrel. It will be seen that the portion 24 is frustoconical in shape (the term "tapering conically" herein embraces a frustoconical configuration) and coaxial with the cylindrical region 23 of maximum mandrel diameter.

The maximum radius of the mandrel is equal to the internal radius of the preform side wall 11 (allowing for appropriate clearances) while the minimum radius at the end 25 of the tapering portion 24 is less than or equal to the minimum radius of the profile to be imparted to the preform side wall. Before spin forming, the forward end 25 of the mandrel is inserted (FIG. 1A) downwardly into the hollow cylindrical preform side wall through the open upper end thereof and in coaxial relation thereto, to such an extent that the tapering portion 24 of the mandrel is below the location of the discs 20 relative to the vertical axis 18. As thus inserted, the region 23 of the mandrel is in substantially 360° contact with the inner surface of the upper part of the preform side wall, and the mandrel is maintained in coaxial relation to the preform side wall during the spin forming operation.

Also, the mandrel is free to rotate on its axis, so that the driven rotary motion of the preform is picked up by the mandrel, during spin forming, by frictional contact between the mandrel and the side wall inner surface, causing the mandrel to rotate with the preform. At the same time, the surface of the mandrel is such as to enable axially directed sliding movement (translation) of the preform relative to the mandrel. Anisotropic friction may be produced by applying a textured surface to the mandrel to assist in achieving this combination of rotational pick-up and translational freedom.

Stated broadly, with this tooling, spin forming is effected by continuously rotating the workpiece 10 (which in turn rotates the mandrel 22 and the discs 20) while unidirectionally translating the workpiece in the direction of taper of the inserted mandrel (i.e. downwardly, in FIGS. 1A–1C) with concomitant radial movement of the discs relative to the axis 18, in directions to taper the workpiece by spin forming with the discs in maintained edgewise contact with the outer side wall of the workpiece, and while translating the mandrel 22, relative to the forming discs 20, in directions to maintain the conical portion of the mandrel in substantially 360° contact with the inner side wall of the workpiece at the location of contact of the discs with the workpiece side wall.

Figure 3A:
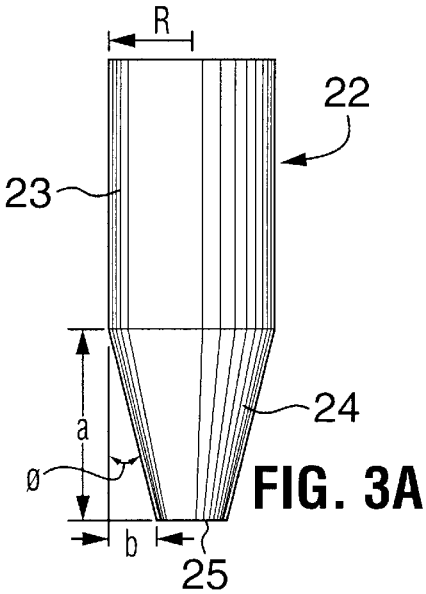
FIGS. 3A and 3B are side views (at different scales) of the mandrel of the system of FIGS. 1A–1C, in illustration of various dimensions and relationships.
Figure 3B:
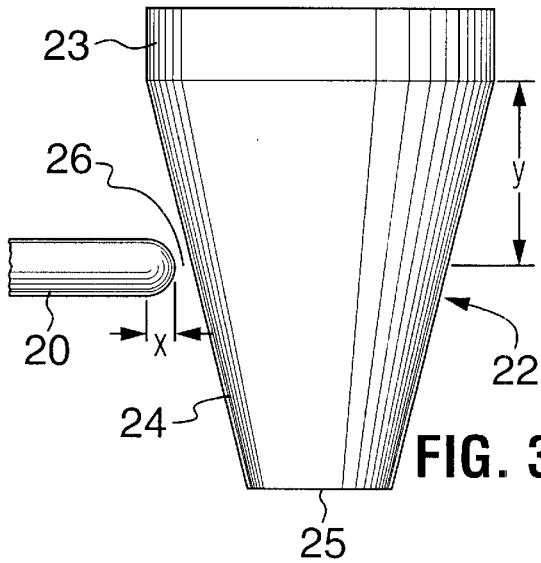

The desired profile of the workpiece side wall 11 is achieved by axial motion of the side wall 11 in the −y direction indicated in FIG. 1A, radial motion of the spin-forming discs 20 illustrated as motion in ±x directions in FIG. 1A, and axial motion of the tapered mandrel 22 in ±y directions in FIG. 1A. More particularly, the radially movable forming discs 20 bear inwardly against the side wall 11, pressing the side wall against the inserted mandrel; in other words, the discs 20 and the mandrel 22 define a gap 26 which is occupied by the side wall moving past the location of the discs. This gap between the forming discs and the mandrel follows the desired profile as the workpiece moves axially in the −y direction; the forming discs move radially as required to achieve this profile, and the mandrel moves axially as required to maintain the gap between the forming discs and the mandrel. For a uniform gap, the axial position $y_M$ of the mandrel is $$y_M=(a/b)x_D$$

where $x_D$ is the radial position of the forming discs and a/b is the slope of the tapered section of the mandrel (see FIG. 3).

With further reference to FIG. 3, considerations pertinent to limits of mandrel dimensions (ignoring any specific definition of necessary clearances between the tooling and the workpiece) may be explained as follows:

R, the maximum radius of the mandrel, is also the inner radius of the undeformed workpiece side wall. Dimension b is the maximum reduction in workpiece radius that can be achieved with tooling including the mandrel. As will be apparent, the radius of the mandrel at end 25 (the lower end of the frustoconical region 24) is equal to the minimum attainable inner radius in the formed product, using this tooling. When the mandrel is inserted into a closed-end workpiece (as shown in FIG. 1A), its travel is limited by contact of end 25 with the inside of the bottom of the workpiece. Thus, the spin-forming operation begins at a minimum distance a from the inside bottom of the workpiece; the mandrel end 25 could be shaped or hollowed to accommodate a domed beverage can bottom, allowing a greater dimension a. The dimension a is irrelevant for an open-end preform or workpiece, apart from defining the angle of the taper which in turn defines the relationship between the motion of the forming discs and the mandrel.

The angle θ of taper of the mandrel (=arctan b/a) is made to be between about 5° and about 85°, preferably between about 20° and about 60°.

In general, the ratio a/b should be made as high as practical. However, as this ratio increases, the effect of friction between the inside surface of the workpiece and the mandrel will increase the axial load on the workpiece, which will provide a practical upper limit. A high a/b ratio will allow more room for multiple sets of discs, with each set offset axially, to be used, as described below. A high a/b ratio may also enhance the effect of off-axis spin forming discs to minimize axial load. The upper limit on a/b can be overcome with multiple passes. Each successive pass would have a smaller b dimension to allow further reduction in radius of the workpiece side wall.

FIG. 1A illustrates the positions of workpiece and tooling at the start of a spin-forming operation. The mandrel is positioned with the lower end of its maximum-diameter region 23 at the location of the discs 20 along the axis 18. The discs are positioned in edgewise contact with the external surface of the workpiece side wall 11, so that the side wall is within, and fills, the gap 26 defined between the edge of each disc 20 and the mandrel 22. Stated in other words, at the location (along axis 18) at which the side wall is externally engaged by the disc edges, it is backed up internally by the mandrel substantially around a full 360°.

To initiate spin forming, the table 16 is driven to rotate the workpiece 10 about axis 18, this rotation being transmitted by frictional contact to the discs 20 and the mandrel 22. The table 16 begins to be translated unidirectionally downward along the vertical axis 18, i.e. in the direction of taper of the mandrel portion 24, causing the workpiece side wall to begin to descend past the location of the discs. At the same time, the mandrel begins to be translated progressively upwardly along axis 18 relative to the workpiece and the discs 20, with the result that the radius of the mandrel at the location of the discs becomes progressively smaller owing to the downward conical taper of the mandrel portion 24, while the four discs 20 are moved, symmetrically, progressively radially inwardly toward the axis 18. The upward translation of the mandrel is concomitant with the radial inward motion of the discs so that the gap 26 is maintained substantially constant in width between the discs and the mandrel notwithstanding that the inner and outer radii of the gap become progressively smaller.

This combination of motions produces, in the axially extended region of the workpiece side wall 11 that is engaged by the discs as the workpiece descends, a progressive taper or decrease in radius, as shown at 28 in FIG. 1B. The taper is formed because the discs 20, moving radially inward, progressively deform the side wall portion inwardly. The deformation always occurs directly against the mandrel; i.e., the workpiece side wall is always backed up by the mandrel around 360° at the location of deforming contact of the discs with the side wall portion, owing to the fact that the upward translation of the tapering mandrel corresponds to the radially inward motion of the discs to maintain the width of gap 26 substantially constant.

In the specific forming operation of FIGS. 1A–1C, the region 28 of progressive upward taper formed in the workpiece side wall is to be followed by a region 30 of progressive upward flaring, in which the radius of the side wall increases progressively until it returns to the original radius of the undeformed side wall. FIG. 1B illustrates the completion of forming of the upwardly tapering region 28. To form the upwardly flaring region 30, the table 16 and workpiece 10 continue their unidirectional downward translation, moving the side wall 11 on downwardly past the location of the discs 20. The discs, however, are caused to move symmetrically and progressively radially outward, while the mandrel 22 is translated downwardly so that the radius of its tapering portion 24, at the location of the discs, increases progressively in correspondence with the radially outward movement of the discs, once again maintaining the width of the gap 26 substantially constant. The completion of spin forming of the flaring region is shown in FIG. 1C; it will be noted that once again the lower extremity of the maximum-diameter region 23 of the mandrel is at the location of the discs along the axis 18, as in FIG. 1A, but the workpiece in FIG. 1C is displaced downwardly from its position relative to the discs in FIG. 1A, by a distance equal to the combined axial length of regions 28 and 30, in which a smooth constriction has been formed in the workpiece side wall.

As a result of the unidirectional taper of the mandrel, and the unidirectional translation of the workpiece, the mandrel can be removed after the spin forming operation even if the final profile is undulating in nature.

In a modification of the tooling assembly described above, the array of forming discs can be made unidirectionally axially translatable in the +y direction (i.e., upwardly along axis 18, opposite to the direction of mandrel taper) as well as radially movable, with the workpiece maintained stationary in position along the axis (although still driven for rotation about the axis). Thus, the described unidirectional translation of the workpiece relative to the discs can be effected by translating the discs rather than the workpiece along the axis 18.

The relative motions of the forming discs, mandrel and workpiece are precisely coordinated by an appropriate control system (not shown). Radial motion of the forming discs can be achieved through position control or by maintaining the discs in contact with the preform at a controlled pressure (e.g. by spring loading). The reduction in radius of the workpiece side wall is accompanied by a combination of wall thickening and axial elongation. The relative amounts of each can be controlled by adjusting the clearance of the gap between the mandrel and the forming discs.

Figure 4:
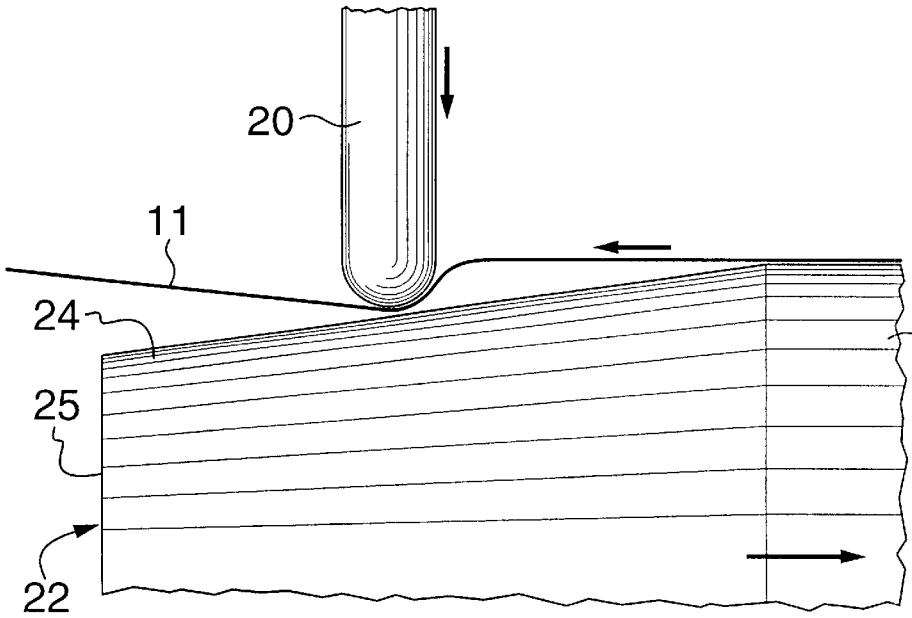
FIG. 4 is an enlarged fragmentary view similar to FIG. 1B, showing directions of motion of the container (preform), mandrel and forming discs.

FIG. 4 indicates directions of motion in a spin forming operation in accordance with the invention, using a single set of forming discs 20. In the absence of the coaxial tapered mandrel 22, wrinkling of the side wall 11 would occur even for relatively small reductions in diameter.

Figure 5A:
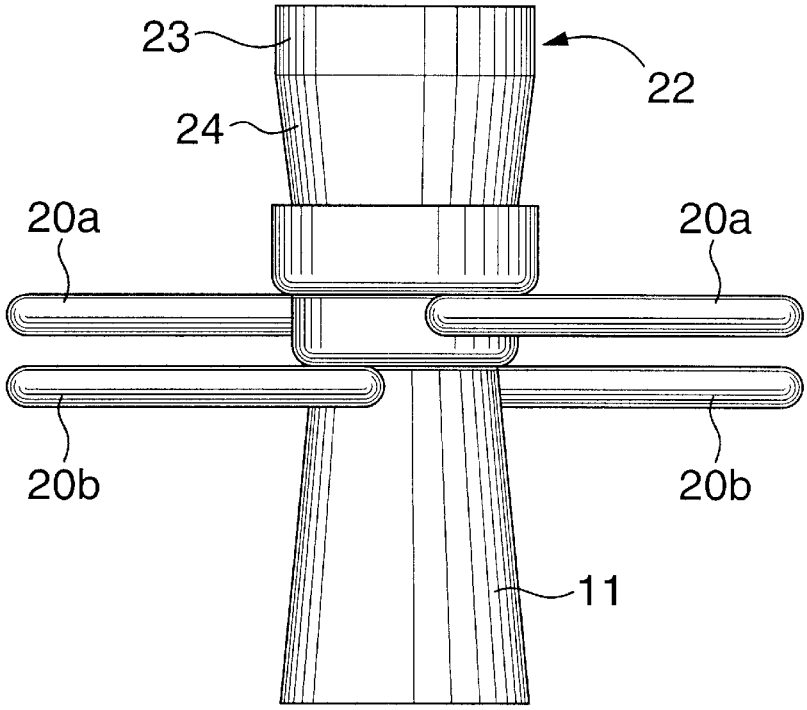
FIGS. 5A and 5B are, respectively, simplified schematic side elevational and perspective views in illustration of a modified embodiment of the invention employing two sets of forming discs in tandem.
Figure 5B:
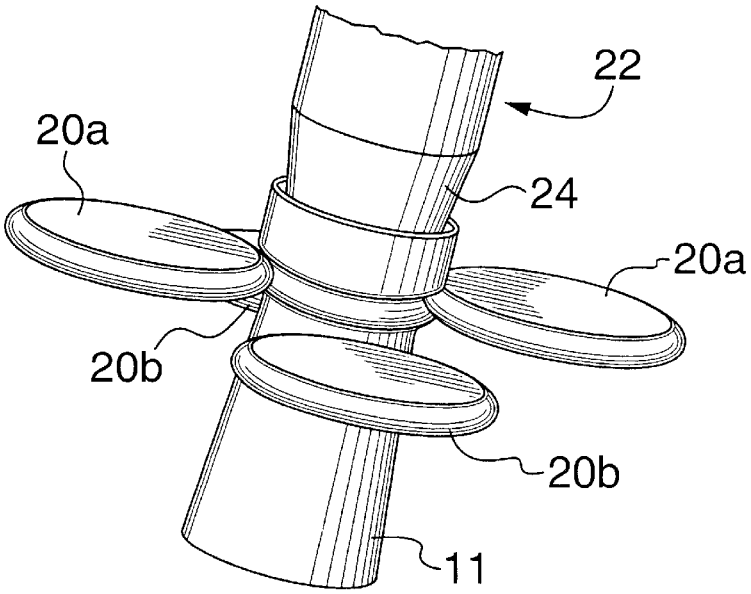

Even with the mandrel, wrinkling can occur if the reduction becomes too great, using a single set of forming discs. A second set, or plural additional sets, of forming discs or a succession of passes using progressively smaller mandrels is required to achieve such large reductions in radius of the workpiece without wrinkling. FIGS. 5A and 5B are two views showing two sets of symmetrically arranged discs, respectively designated 20*a* and 20*b*, disposed in tandem along the axis of the workpiece side wall, as used to form the extremity of the neck portion of a bottle shaped container.

In the spin forming operation, the gauge and mechanical properties of the workpiece side wall are significant. For example, whereas the above-described exemplary forming operations are applicable to an aluminum alloy, "O" temper, fully recrystallized sheet, a heavily cold worked sheet (e.g. asironed H19) may need to be subjected to a recovery anneal prior to spin forming.

The present invention allows complex contours to be formed on cylinders with relatively thin walls. For instance, a narrow neck can be formed on a beverage container to give it a bottle shape. Necked regions or "waists" (regions of radius smaller than that either above or below) can also be formed, providing an alternative to forming by internal pressure for shaping cans. An advantage of the present method over internal pressure forming is that the strains produced are for the most part compressive rather than tensile; hence forming is not limited by tensile failure as in internal pressure forming.

In some cases, the forming method of the invention may be applied to only a small cylindrical side wall portion of a workpiece that is otherwise formed in other ways and may be noncylindrical. For instance, the method as illustrated in FIGS. 5A and 5B could be applied to a cylindrical neck side wall portion of a container having a major portion previously shaped by internal pressure forming.

It is to be understood that the invention is not limited to the features and embodiments hereinabove specifically set forth, but may be carried out in other ways without departure from its spirit.

What is claimed is:

1. A method of spin forming a hollow workpiece having an initially cylindrical side wall portion with an axis and at least one open end, comprising (a) disposing, coaxially within the side wall portion, a mandrel tapering conically in one direction from a region of maximum radius at which the mandrel is in substantially 360° contact with the side wall portion;

(b) disposing a plurality of rotatable forming discs symmetrically externally around and in edgewise contact with the side wall portion at a location, along the axis, through which the mandrel extends, for pressing the side wall portion inwardly against the mandrel at said location; and (c) rotating the workpiece about the axis while (d) unidirectionally translating the workpiece, in the direction of taper of the mandrel disposed within the side wall portion, along the axis relative to the forming discs, (e) moving the forming discs radially symmetrically in maintained edgewise spin-forming contact with the cylindrical side wall portion at the aforesaid location to vary the radial distance of the discs from the axis, and (f) translating the tapering mandrel along the axis relative to the forming discs and the workpiece to vary the radius of the tapering mandrel at the aforesaid location concomitantly with the varying radial distance of the discs from the axis.

2. A method according to claim 1, wherein the rotating step comprises positively rotating the workpiece about said axis, with rotation being transmitted by the workpiece to the mandrel and forming discs by frictional contact of the workpiece therewith.

3. A method according to claim 1, wherein the translating step comprises unidirectionally translating the workpiece along the axis in said direction of taper, and independently translating the mandrel along the axis, while the discs are maintained substantially stationary in position along the axis.

4. A method according to claim 1, wherein the translating step comprises unidirectionally translating the forming discs along the axis in a direction opposite to said direction of taper, and independently translating the mandrel along the axis, while the workpiece is maintained substantially stationary in position along the axis.

5. A method according to claim 1, wherein the workpiece is a cylinder of initially uniform radius, open at both ends.

6. A method according to claim 1, wherein the workpiece is a preformed container having one closed end.

7. A method according to claim 1, wherein the workpiece includes a noncylindrical portion disposed in tandem relation to said cylindrical side wall portion.

8. A method according to claim 1, wherein the workpiece is a metal container, and wherein steps (d), (e) and (f) are performed to impart a bottle shape to the workpiece.

9. A method according to claim 1, wherein said plurality of discs includes at least two sets of symmetrically disposed discs arranged in tandem along the axis.

10. A method according to claim 1, wherein the mandrel has an angle of taper between about 5° and about 85°.

11. A method according to claim 10, wherein said angle is between about 20° and about 60°.

* * * * *